US007591305B2

(12) United States Patent
Brookey et al.

(10) Patent No.: US 7,591,305 B2
(45) Date of Patent: Sep. 22, 2009

(54) PATRIOT RETRIEVABLE PRODUCTION PACKER

(75) Inventors: Robert L. Brookey, Tulsa, OK (US); Michael T. Sommers, Beggs, OK (US)

(73) Assignee: Tejas Complete Solutions, LP, The Woodlands, TX (US)

( * ) Notice: Subject to any disclaimer, the term of this patent is extended or adjusted under 35 U.S.C. 154(b) by 0 days.

(21) Appl. No.: 11/300,280

(22) Filed: Dec. 15, 2005

(65) Prior Publication Data

US 2006/0225877 A1 Oct. 12, 2006

Related U.S. Application Data

(60) Division of application No. 10/418,120, filed on Apr. 18, 2003, now Pat. No. 7,082,991, application No. 11/300,280, which is a continuation-in-part of application No. 11/098,423, filed on Apr. 5, 2005, now abandoned.

(60) Provisional application No. 60/373,309, filed on Apr. 18, 2002, provisional application No. 60/373,308, filed on Apr. 18, 2002.

(51) Int. Cl.
*E21B 33/129* (2006.01)
*E21B 33/128* (2006.01)

(52) U.S. Cl. ..... 166/134; 166/240; 166/387

(58) Field of Classification Search ..... 166/134, 166/181, 182, 331, 387, 240, 123
See application file for complete search history.

(56) References Cited

U.S. PATENT DOCUMENTS

| | | | | | |
|---|---|---|---|---|---|
| 3,043,372 | A * | 7/1962 | Davis | 166/140 |
| 3,416,608 | A * | 12/1968 | Crow et al. | 166/129 |
| 3,548,936 | A * | 12/1970 | Pumpelly et al. | 166/121 |
| 3,570,596 | A * | 3/1971 | Young | 166/129 |
| 3,631,927 | A * | 1/1972 | Young | 166/134 |
| 3,746,090 | A * | 7/1973 | Read et al. | 166/134 |
| 4,593,765 | A * | 6/1986 | Greenlee | 166/387 |
| 4,648,446 | A * | 3/1987 | Fore et al. | 166/123 |
| 4,693,309 | A * | 9/1987 | Caskey | 166/123 |
| 4,750,564 | A * | 6/1988 | Pettigrew et al. | 166/387 |
| 5,197,547 | A * | 3/1993 | Morgan | 166/387 |
| 5,273,109 | A * | 12/1993 | Arizmendi et al. | 166/123 |
| 5,449,040 | A * | 9/1995 | Milner et al. | 166/382 |
| 6,257,339 | B1 * | 7/2001 | Haugen et al. | 166/387 |

* cited by examiner

*Primary Examiner*—Shane Bomar
(74) *Attorney, Agent, or Firm*—Merck, Blackmon & Voorhees, LLC

(57) ABSTRACT

The present invention provides a tool capable of being set and released. A novel arrangement of a push sleeve in the spring body eliminates several shear pins while an internal J slot formed directly on the mandrel significantly reduces the size of the lower drag body and thus the length of the tool. An internal pathway between the inner mandrel and the mandrel body selectively provide increase flow through the packer tool to facilitate running in of the tool.

19 Claims, 2 Drawing Sheets

PATRIOT RETRIEVABLE PRODUCTION PACKER

CROSS REFERENCE TO RELATED APPLICATIONS

This application is a divisional of application Ser. No. 10/418,120 filed Apr. 18, 2003 now U.S. Pat. No. 7,082,991 entitled Slip Spring with Heel Notch, which is hereby incorporated by reference, which in turn claims the benefit of provisional applications Ser. No. 60/373,309 filed Apr. 18, 2002, entitled Patriot Retrievable Production Packer which is hereby incorporated by reference, and Provisional Application 60/373,308 filed Apr. 18, 2002, also hereby incorporated by reference. This application is also a continuation in part of U.S. application Ser. No. 11/098,423 filed Apr. 5, 2005 now abandoned, which is incorporated herein by reference.

BACKGROUND OF THE INVENTION

A. Field of the Invention

The present invention relates to a retrievable production packer for zone isolation, injection, pumping and production.

B. Description of the Prior Art

Wireline set packer tools are well known and have been used in the industry for many years. See for instance U.S. Pat. No. 5,197,547 issued Mar. 30, 1993 to Allen B. Morgan which is incorporated herein by reference. In Morgan, a combination of shear pins, spring tools, and J slots are used to control insertion, setting, and retrieval of the tools. Through sequential release of the shear pins and springs, a top slip body and a lower drag body are moved in contact with a packer body thereby expanding the packers to seal a zone in a well bore. The complexity of the parts and their manufacture has continued to increase to provide complex movements to set and release the parts of the tool.

The present invention provides a tool capable of being set and released without requiring the complexity of former tools. A novel arrangement of a push sleeve in the spring body eliminates the need for several shear pins while an internal j slot formed directly on the mandrel significantly reduces the size of the lower drag body and thus the length of the tool. These and other improvements to the packer tool result in a significantly simplified tool capable of meeting the full requirements of a production packer.

None of the above inventions and patents, taken either singly or in combination, is seen to describe the instant invention as claimed.

SUMMARY OF THE INVENTION

Accordingly, it is a principal object of the invention to provide a retrievable production packer tool having a novel arrangement of parts capable of isolating zones in a well bore.

It is a further object of the invention to provide a packer tool having an internal J slot on the mandrel to reduce the overall length of the packer tool.

Still another object of the invention is to provide a packer tool having a molded seal in the rubber mandrel to selectively seal the packer tool when the tool is set.

It is a further object of the invention to provide a packer tool having a lower cone collet for setting the lower slips and allowing retrieval of the lower drag body during removal of the tool.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention relates to a retrievable packer tool 100. Illustratively, a production packer tool is shown which has as its main purpose to be installed in a wellbore to seal the zone above the packer from the zone below the packer. Since conditions around the well bore can change, the packers may have to be moved, removed, or reinserted. Since the tools are positioned a great distance below the earth and the size of the wellbore is extremely small, it is impractical to send a man to retrieve the tools. The distances also make it a major undertaking to send any tool in to manipulate the tool. The size and distance between the operator and the tool and the limited room to manipulate the tool inside the wellbore leave only a few kinds of motion that can be used to act on the tool to change the orientation or operation of the tool. Among these ranges of actions available are pushing downward on the tool, lifting upward on the tool, clockwise or counterclockwise rotation of the tool and a combination of these movements.

The limited movements have necessitated that the tools have complex actions built into them so that when a certain sequence of the above actions are taken, the tool will perform one of its several intended functions such as setting, running, or releasing. The current invention represents a simplification of the manufacture and arrangement of the tool, while still allowing the tool to be selectively run into a hole, set at the desired location and released using only the limited range of control movements from the operator. Prior art devices have relied on a number of shear pins arranged to fail as the downward forces on the tool increased to shear the pins in a predetermined sequence to initiate different reactions by the tool. Elimination of complex parts and the rearrangement of parts according to the present invention represent a substantial savings in the cost of manufacture as well as the size and reliability of the tool.

Figure 1:
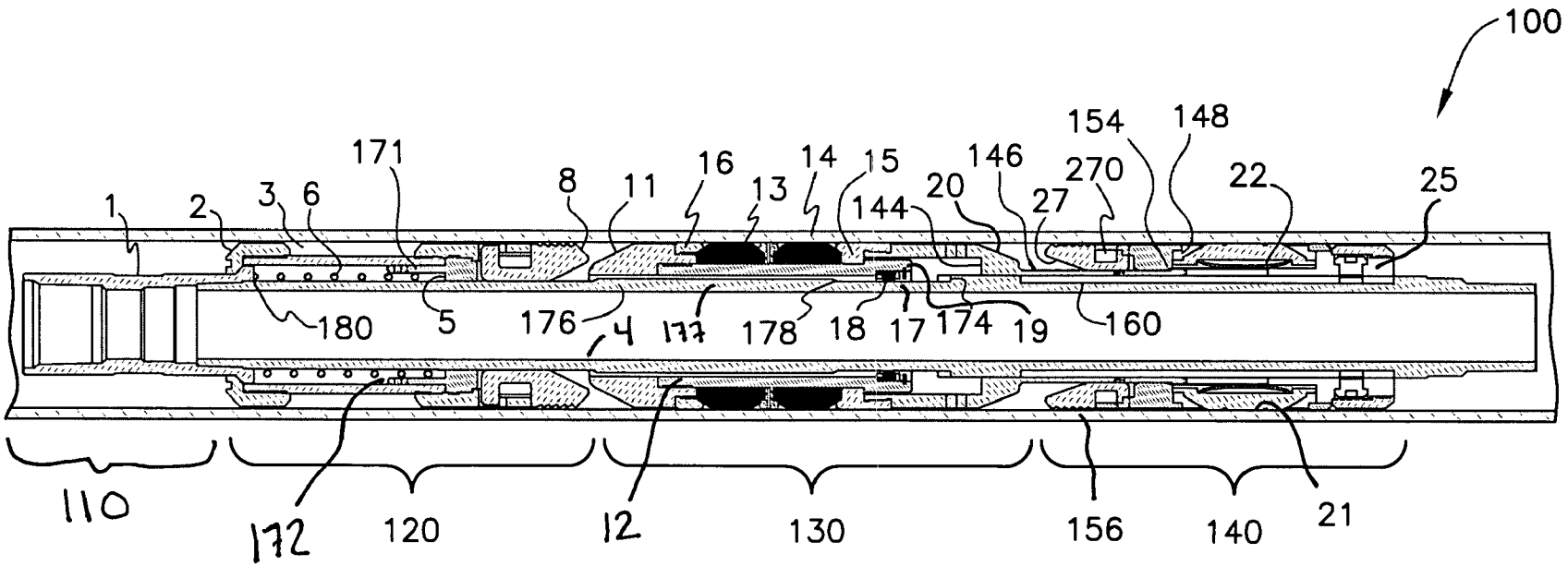
FIG. 1 is a side plan view of the production packer tool according to a preferred embodiment of the present invention.

As shown in FIG. 1, the tool is divided into several major parts, the tubing 110, the upper slip body 120, the lower drag block body 130 (which is also the "lower slip body"), and the rubber mandrel assembly ("packer body") 140. Though these demarcations are only for illustrative purposes as the parts overlap somewhat by necessity as will be hereinunder explained.

The tubing includes a top sub 1 connected to an inner mandrel 4 upon which all of the other components, including the rubber mandrel body 140, are mounted. The center of the tool is the rubber mandrel body 140 which includes preferably two packer elements 13, though more or less elements could be used depending on the location and requirements. The packer elements are made of extremely durable rubber or similar compositions and are expanded outwardly to engage the inner wall of the well bore when the rubber mandrel body 140 is compressed ("packed off").

At either end of the rubber mandrel assembly is the upper cone 11 and lower cone 20. The purpose of the cones is to expand the slips 8, 27 outwardly to lock the upper and lower slip bodies 120, 130 into position about the rubber mandrel assembly as will be explained further below.

Between the upper and lower cones 11,20 is located the packer elements 13. The packer elements are held securely between two retaining rings 15,16 and are separated by a cylindrical or ring-shaped spacer 14. Preferably the retaining rings and the spacer are each made of steel or similar material so that during compression of the rubber mandrel assembly, only the packer elements compress to maximize the outward expansion of the elements. When the packer elements 13 are forced outwardly they seal against the internal surface of the well bore to provide a seal between portions ("zones") of the wellbore above the packer elements and below the elements until the packer elements are released from the compressive forces thereon.

The packer elements 13 are positioned radially outward from a steel rubber mandrel 12 which locates the rubber packer elements 13 between the retaining rings 15 and spacer 14 and ensures that the packer elements can only expand outwardly during setting. The rubber mandrel 12 is preferably made of steel to resist any inward force of the rubber packer elements 13.

The rubber mandrel 12 has an overall length less than the cavity inside the upper and lower cones 11,20 when the cones are un-compacted. Thus normally the rubber mandrel is unexpanded when the cones are in their "relaxed" state. As shown in FIG. 1, as the rubber mandrel assembly is compressed, the cones 11,20 can compress towards each other until the internal shoulder 144 of the lower cone 20 contacts the lower end of the rubber mandrel 12. This distance controls the amount of compression ("pack off") of the rubber elements. However, when the rubber mandrel assembly is not in compression or when the compression is released, the packer elements 13 will return to their original shape forcing the cones apart from each other and withdrawing the packer elements 13 from the wall of the wellbore unsealing the zones above the packer elements from those below the packer elements.

In order to compress the packers, which is the main function of the other parts of the tool, an upper and lower slip body 120, 130 are provided at either end of the rubber mandrel body. The lower slip body, also called the lower drag body 130, is slidingly secured to a tubular extension 146 of the rubber mandrel assembly 140. A release collet 148 (FIG. 2) provided at the end of the tubular extension allows the tubular extension 146 (FIG. 1) to be interference fit with the lower drag body 130.

Figure 2:
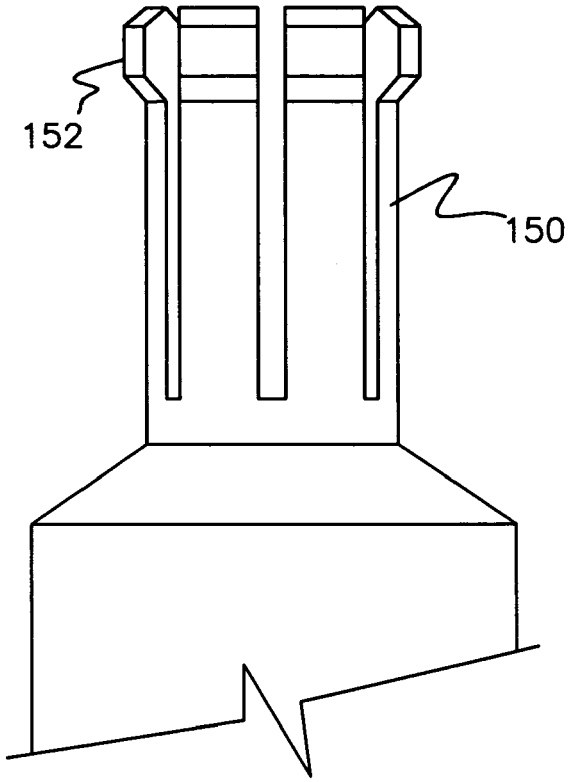
FIG. 2 is a side elevation view of the collet according to the preferred embodiment of the invention.

As shown in FIG. 2, the collet 148 at the termination of the tubular extension 146 is formed by a number of axially slots around the circumference of the tubular extension to form separate fingers of the collet. The axially slots allow the tubular extension to be compressed during insertion into the lower drag body 130. Each finger 150 ends in an outwardly turned neck portion 152 which acts as a lock in conjunction with an internal shoulder 154 of the lower drag body 130. When the mandrel ("tubing") 4 is inserted through the rubber mandrel assembly 140 and though the lower drag body 130, the neck 152 of the collet thus cannot pass by the shoulder of the lower drag body without compressing inwardly. However, the collet cannot compress inwardly because of the close fit between the mandrel 4 and the tubular extension 146. This locks the lower mandrel on the rubber mandrel to ensure that drag body is retrieved with the rubber mandrel assembly, but allows the lower drag body to slide along the tubular extension between the neck of the collet on the tubular extension and the lower cone of the rubber mandrel assembly 140.

The lower drag body is so called because it contains the drag body 21. Drag bodies are well known in the art and as shown in FIG. 1 includes an internal spring 22 urging the drag block 21 outwardly. The spring strength is chosen such that the drag block provides a moderate amount of friction between the drag body and the inner wall of the well bore while allowing the tool to be tripped down the wellbore ("inserted"). The purpose of the drag blocks, as is well known, is that it allows the drag block to be manipulated by turning or otherwise acting on the drag block when the packer tool 100 reaches the proper depth in the wellbore.

The drag block body 130 also includes lower slips 27 and a J pin 25. The slips are well known as shown as elements 27 and 57 in the Morgan patent which has been incorporated herein by reference. The slips of the present invention are mounted in the drag body 130 by inserting the head of the slip into an opening in the drag body sized to receive the slip 27 as shown in parent application Ser. No. 10/418,120, filed Apr. 18, 2003. The tail end of the slip extends beyond the upper end of the lower drag body 130 such that one rib 156 of the drag body 130 is trapped in a pocket of the slip body. Intermediate the slip and the rib of the drag body is a spring for urging the slip away from the rib and inwardly away from the wellbore. This spring acts to retract the slip into the position shown in FIG. 1 when the tool is being run in ("inserted") into the well bore to reduce the force necessary to insert the packer tool into the wellbore.

When the lower drag body 130 is caused to slide along the tubular extension 146 towards the lower cone 20 of the rubber mandrel assembly 140, the slips are brought into contact with the lower cone 20. An inner edge of the slips 27 is tapered inwardly to form a cone in conjunction with the other slips of nearly mating shape to the lower cone 20. As the lower drag body further approaches the rubber mandrel assembly, the interaction of the slips with the lower cone 20 causes the slips to expand outwardly compressing the slip spring between the slip and the lower drag body rib 156.

The slips continue to extend outwardly as it rides up the lower cone of the rubber mandrel assembly until it is brought into contact with the inner surface of the well bore. Teeth along the tail of the slip help lock the slip into position with the well bore to trap the drag body 130 into set position along the well bore. Likewise a mirror image set of upper slips 8 are installed in a like manner in the upper slip body 120 and operate in a like manner.

The J pin 25 provided in the lower drag body which controls the relative motion between the lower drag body 130 and the rubber mandrel assembly 140 and likewise the travel of the lower drag body along the tubular extension 146 of the rubber mandrel assembly. As best shown diagrammatically in FIG. 3, a J slot 160 is provided on an outer surface of the mandrel 4 radially inward from the drag body 130.

The J pin is selected to be of sufficient length to ride within the J slot of the mandrel to control the motion of the drag body between several positions. A first position 162 is provided for run in ("insertion") of the tool where the pin is in a position in the slot furthest from the rubber mandrel assembly. The lower drag body 130 is run in while separated from the lower cone of the rubber mandrel to prevent the lower slips 27 from extending and impeding progress of the packer tool's insertion into the well bore. However, the drag blocks will still be in contact with the well bore to allow the tool to be manipulated as it is inserted.

The J pin has a second position 164 at the topmost portion of the J slot closest to the packer. This is the maximum compression (of the mandrel) resulting from placing the most downward compression on the tubing during setting. When the J pin is in this position, the rubber mandrel assembly and the lower drag body are in close contact with both the packer elements 13 expanded and the slips 27 expanded in contact with the well bore. However, it is not necessary to be in this extreme position to fully seal the bore. Because of the split axis of the J slot, releasing the tension or even putting the tubing in tension (i.e., pulling on the tubing) will cause the J pin to move to a third position 166 where the tubing is in tension, but the rubber mandrel assembly is still in compression ("packed off") and the packer tool 100 cannot be accidentally released solely by upward tension on the tubing. All along the J slot between the tension position 166 and the compression position 164 the tubing can be manipulated while the packers remain packed off.

Only when the J pin is between a fourth crossover position 168 and a release position 170 can the packing elements be released or set as will be described further below in the "operation" section. This provides the packer tool to be locked in its set position with the tubing in either tension, compression or a neutral position between the two.

The upper slip body 120 has a number of upper slips 8 arranged about its lower periphery which have the same configuration and operation as the lower slips 27 and interact with the upper cone 11 in the same way that the lower slips interact with the lower cone 20. However, no drag block or J pin need be provided, as will be described below.

The upper slip body 120 contains a spring cage 3 and spring 6. The spring is located between the top sub 1 and a push sleeve 5. The push sleeve includes a wall 172 to absorb the force of the top sub directly when the pressure of the top sub on the upper slip body 120 exceeds the force of the spring 6 to protect the spring and to allow more force to be applied directly to the packer tool from the tubing.

Operation of the Packer Tool

In operation of the packer tool 100, the tool is assembled above ground for run in into the well bore. The lower drag body 130 is inserted over the collet 148 and tubular extension 146 of the rubber mandrel assembly 140. The rubber mandrel and lower drag body are inserted onto the mandrel 4. The J pin 25 is inserted into the J slot 160. The J pin is moved along the slot until it is positioned in the run in position 162. The upper slip body 120 is then inserted over the mandrel 4. Top sub 1 is then threaded onto the mandrel securing the upper slip body in place.

The top sub is then affixed to the rest of the tubing on the tubing string for insertion into the well bore. With the packer elements 13 retracted and the upper and lower slips 8,27 retracted, the tool 100 is inserted into the wellbore with only the drag blocks contacting the outer wall. It should be noted that as the tool is run in, the weight of the upper slip body will tend to force the slips 8 downwardly onto cone 11 forcing the slips out against the wall of the wellbore which could result in premature setting of the slips. However, spring 6 will allow the slips to withdraw away from the cones before any significant friction develops between the slips and the wall. As soon as the slips 8 catch on the wellbore, the upward force of the wall on the slip will cause spring 8 to compress against top sub 1 allowing the slips to withdraw upwardly from the cone 11 thereby retracting the slips from the wellbore before significantly impacting the run in of the tool. The tool can thus be run in to the well bore until it reaches the desired depth where the packer seals are to be deployed to seal the zone below the tool from the zone above the tool.

When the proper depth is reached, it is necessary to set the packer elements 13. To set the packer elements, the upper and lower slips must be deployed to put the rubber mandrel assembly into compression to compress the packer elements 13 outwardly.

The transition from run in to setting (and to retrieval) is the function of the lower drag body 130 by moving upwardly into the rubber mandrel assembly 140. However, this relative motion is prevented by the J pin 25 locking the lower drag body in place along the mandrel while the packer is prevented from moving towards the rubber mandrel assembly by the interaction of retaining ring 19 against shoulder 174.

The J pin 25 must be moved from the run in position 162 to the crossover position 168 to allow the lower drag body to slide along the rubber mandrel assembly tubular extension 146 so that the slips can contact the lower cone 20 to deploy the slips against the wall of the well bore. To achieve this, an initial tension is placed on the tubing by "picking up" on the tubing after the wellbore has been positioned at the proper depth. After halting the progress of the tool in the well bore, quick pressure on the tool 100 through the tubing will cause the mandrel 4 to move upwardly relative to lower drag body which is inhibited from moving freely by drag blocks 21. Since the J pin is installed in the lower drag body, the J pin likewise will move downwardly relative to the mandrel 4.

The drag blocks 21 will slow the progress of the tool in the well bore sufficiently to allow this relative motion between the drag body and the mandrel by frictionally "dragging" the drag blocks against the well bore wall while the mandrel is under no such friction. With the pin thus moving downwardly in the slot 160 of the mandrel to its bottom dead position, the tubing can be rotated to free the pin from the run in position. Without this initial "pick up" the pin would be prevented from rotating relative to the slot by the shoulder 165 thereby preventing the tool from prematurely setting.

Figure 3:
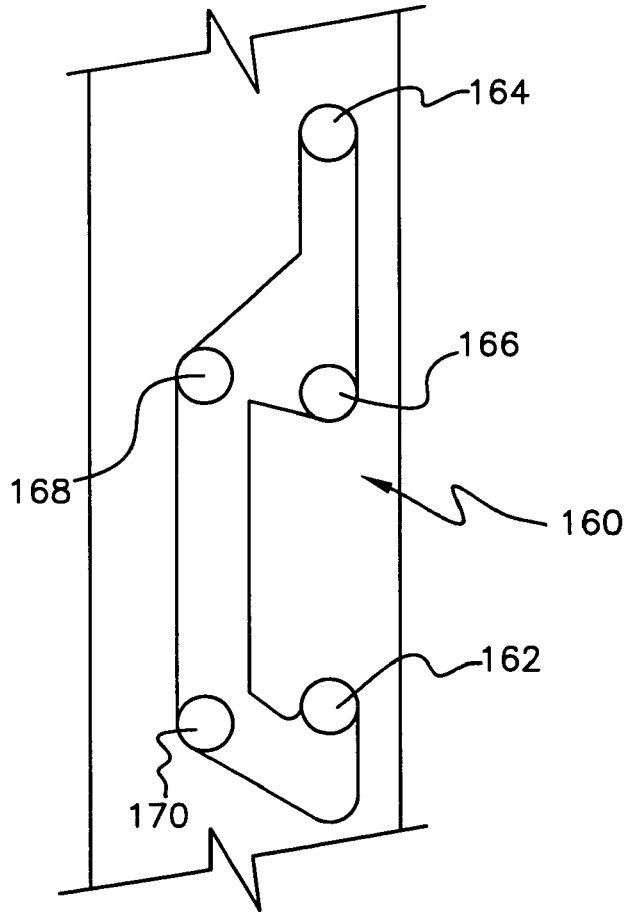
FIG. 3 is a diagrammatic view of the J tool slot according to a preferred embodiment of the present invention.

During this initial rotation the tubing is preferably rotated about one quarter turn to the right (moving the pin one quarter turn left relative to the slot). By setting down which will put the tubing in compression, the pin will be caused to travel upwardly relative to the slot as the mandrel is lowered. With the lower drag body 130 free to travel relative to the mandrel, the rubber mandrel assembly 140 will travel downwardly with the mandrel causing the lower cone 20 to slide behind the lower slips 27 forcing the slips outward into contact with the well bore as described above. As best shown in FIG. 3, the right hand pressure on the tubing 110 should be released to allow the mandrel to rotate back to the left as the tubing is continued to be compressed ("pushed downwardly"). The J pin 25 will follow along the wall of the J slot 160 causing the mandrel to move leftward as the J pin moves from the crossover position 168 into the upper slot between the tension position 166 and compression position 164.

The compressive ("downward") force on the tubing will cause the top sub to travel downwardly compressing the spring 6 until the top sub touches the push sleeve wall 172. At the same time the upper slip body 120 will travel downwardly until contacting the rubber mandrel assembly 140. Because the rubber mandrel assembly will provide relatively little resistance to the upper slip body, the rubber mandrel assembly will move downwardly before the slips can fully deploy as they contact the upper cone 11. As more pressure is placed on the tubing the rubber mandrel assembly will continue to travel towards the lower drag body 130 further extending the slips into the wellbore fixing the lower drag body in position. Teeth may be provided along the tail of the slips 27 to further lock the slips against sliding along the wellbore wall.

As the J pin travels past the cross over position, the rubber mandrel assembly will continue to compress against the lower drag body which is now fixed in position and cannot travel further downwardly with the slips locked against the wall. When the rubber mandrel assembly is locked against the lower drag body, pressure of the tubing on the upper slip body 120 will cause the upper slip body to contact the upper cone 11 of the rubber mandrel assembly. The pressure of the tubing will compress the spring 6 until the top sub compresses the spring entirely within the push sleeve wall 172 so that the bottom shoulder 180 contacts the wall 172 of the push sleeve 5. This will allow for a full transfer of the force onto the upper slips 8 to push them into the upper cone 11 and will at the same time force the further compression of the rubber mandrel against the lower slips and lower drag body.

The rubber mandrel 177 inside the rubber mandrel assembly ("inner mandrel sleeve") will move under compression towards the inner shoulder 144 of the lower cone 20 as the rubber mandrel assembly is compressed ("packed off"). This will cause the rubber packer elements 13 to be compressed as the upper cage ring 16 on the upper cone 11 moves towards the spacer 14 and lower cage retaining ring ("rubber retainer") 15. The packer elements will expand outwardly ("pack off") as they are compressed radially until they contact the wellbore wall.

The rubber mandrel assembly will be prevented from re-expanding as the upper slips lock into the wall of the wellbore (as described above) locking the mandrel in compression between the upper slip body 120 and the lower drag body 130. Further, the lost motion provided by the spring 6 in the upper slip body will allow the upper slip body to reduce the pressure on the slips whenever some of the pressure is released from the top sub or if the pressure on the top sub was not sufficient to fully compress the spring during the run in.

This will seal the zone above the packer elements from the zone below the packer elements on the outside of the packer tool. The sealing of the inside of the packer tool is accomplished by the molded seal 17.

During run in, it is desirable to maintain equal pressure across the packer tool to prevent pressure build up from retarding the insertion or removal of the packer tool in the well bore. A pressure equalizing channel 176 is provided by the spacing between the mandrel 4 and the inner mandrel sleeve 12. A seal 17 selectively closes the channel when the packer tool is set and opens the channel when the tool is being run in. A shoulder 178 located along the mandrel is dimensioned to contact the seal as the mandrel moves downwardly relative to the rubber mandrel assembly. During run in, gravity causes the rubber mandrel assembly 140 to move downward relative to the mandrel until the retaining ring 19 rests against mandrel shoulder 174. This allows the channel 176 to remain open allowing pressure equalization across the rubber mandrel assembly 140. When the J pin moves in slot 160 as explained above into the cross over position 168 and the set position between 166 and 164, the mandrel will have moved downwardly relative to the rubber mandrel assembly as the rubber mandrel assembly contacts and is stopped by the lower drag body. The movement of the mandrel will force shoulder 178 against seal 17. Preferably the shoulder 178 is sloped and more preferably is sloped at an angle of 20 degrees to cause the seal 17 to compress to increase the sealing force of the seal against the shoulder. Preferably the seal is part metal and part rubber to withstand the forces on the seal and to maintain the integrity of the seal. And preferably the seal has a pair of o-rings 18 formed about its periphery to aid in sealing. The seal may also be bonded to the inside of the rubber mandrel 12 to securely locate the seal. The use of the pressure equalization channel interior to the tool eliminates the need for providing a section of the mandrel body to accomplish the same task thereby reducing the overall length of the tool and lowering production and installation costs.

This interaction will complete the internal sealing of the zone above the rubber mandrel assembly with the zone below. Since the packer elements 13 have packed off during the same downward mandrel movement, a complete seal of the zones around the packer elements and rubber mandrel assembly will exist.

At this point the tubing is in compression as the tubing is pressed down to compress the rubber mandrel assembly. The J pin should be at or near the top most position 164 or the "compression position." Lifting the tubing will cause the pin to travel downward to the "tension position". The J slot will prevent the mandrel from being released enough to free the lower slips and pressure provided by spring 6 will ensure that the upper slips stay locked into the wellbore allowing the cones 11 to be pulled into the upper slips locking them more securely against the wellbore wall. Thus the packer elements 13 and the rubber mandrel assembly 140 will be locked in compression between the upper slip body 120 and the lower drag body 130. At any point with the J pin locked between compression and tension positions 166,164, including the neutral point, the packer tool will remain packed off.

To add more compressive force to the rubber mandrel assembly, the above process can be repeated to further lock ("land") the rubber mandrel assembly in compression between the upper and lower slips 8,27 by "snugging" the slips closer to the cones in successive application of tension and compression on the tubing. Spring 6 will provide a force on the upper slips to prevent their total release as long as J pin is prevented from returning past the crossover position 168.

Removal ("Tripping Out")

To release the tool and to rejoin the zones above and below the packer tool, the J pin must be manipulated in the slot to allow the parts to move relative to each other. As shown in FIGS. 1 and 3, the J pin 25 must be moved to the left to allow the J pin to return past the crossover position 168 down to the release position 170. Therefore a light compressive force (preferably about 100 pounds) is applied to the tubing while the tubing is turned one quarter turn to the right to align the J pin 25 with the elongated axial slot of the J slot. The tubing is then lifted causing the mandrel to move upward relative to the J pin, thereby causing the J pin to follow the J slot downwardly.

This upward motion of the mandrel relative to the upper slip body, the rubber mandrel assembly and the drag body will first cause a sequential release of the tool as will now be described. The pressure equalization channel 176 will be opened as the shoulder 178 is withdrawn upwardly from the seal 17 opening the lower mouth of the channel.

Spring 6 will also expand as the top sub 1 is pulled upward. The lower shoulder 180 of the top sub 1 will pull the top part ("spring cage cap") 2 of the spring cage upward releasing the slips from the upper cone 11 and from the well bore wall allowing the slips to withdraw into the upper slip body 120. A releasing slip (not shown) may be used to aid in the release of the slips as is well known and described in U.S. Pat. No. 4,530,398 issued Jul. 23, 1985 to Greenlee et al. and which is incorporated herein by reference.

With the top of the rubber mandrel assembly 140 free, the rubber mandrel assembly can expand releasing the packer elements 13 as the mandrel inner sleeve 12 moves away from the wall 144 and the packer element returns to its unexpanded position.

As the rubber mandrel assembly 140 moves out of contact with the lower drag body as the mandrel urges the mandrel upward, the lower slips will release from the well bore wall. The lower neck 152 of the collet will then contact the internal shoulder of the lower drag body pulling the lower drag body 130 upward with the rest of the tool releasing the tool from the wellbore where it can be tripped out of the hole for reuse at a later time.

As a further safety device, should the J pin 25 and J slot 160 become inoperable, the J pin is preferably formed as a shear pin which will separate under a predetermined force to allow the tool to be released in the method described above without moving the J pin within particular course of the slot. It should be noted that prior art devices have used J tools (see for instance the Morgan U.S. Pat. No. 5,197,547), but the relocation of the J tool from the lower drag body to the mandrel location results in significant reduction in the overall length of the tool saving tooling costs, transportation costs and installation costs, etc. while increasing the reliability of the tool.

It is to be understood that the present invention is not limited to the sole embodiment described above, but encompasses any and all embodiments within the scope of the following claims.

We claim:

1. A packer tool for releasably securing a packer within a well bore, the packer tool including:

an inner mandrel;

said inner mandrel having a longitudinal bore therein and an upper and a lower end;

a mandrel body selectively installed on said inner mandrel between an upper slip body and a lower slip body;

at least one packer on said mandrel body for expansion about said mandrel body to selectively seal a zone above said packer tool from a zone below said packer tool;

said mandrel body having a tubular extension at a lower end;

said tubular extension having a collet at an end remote from said mandrel body;

said mandrel body lower end further including an end portion movable relative to said mandrel body to cause said at least one packer to expand and engage the packer against the well bore;

said lower slip body selectively slidably mounted on a first portion of said inner mandrel to selectively cause said end portion to move to cause said at least one packer to expand and engage the packer against the well bore;

said upper slip body slidably mounted on said inner mandrel to compress said mandrel body between said upper slip body and said lower slip body;

said collet configured to mount coaxially about said inner mandrel and to closely surround said inner mandrel, whereby said lower slip body is not slidably removable over said collet when said mandrel body is installed on said inner mandrel and said lower slip body is slidably removable from said collet when said mandrel body is not installed on said inner mandrel.

2. The packer tool of claim 1, wherein said inner mandrel includes a pathway between said inner mandrel and said mandrel body for selectively communicating the zone above said packer tool with the zone below said packer tool.

3. The packer tool of claim 2, wherein said inner mandrel includes a shoulder in axial alignment with a seal on said mandrel body along said pathway, such that when said upper slip body is compressed against said mandrel body, said shoulder contacts said seal to block said pathway and when said upper slip body is not in contact with said mandrel body said shoulder does not contact said seal to thereby open said pathway to communicate the zone above the packer tool and the below the packer tool.

4. The packer tool of claim 1, further comprising:

said upper slip body having a spring housing enclosing a spring for urging a top sub away from said mandrel body;

said spring housing further having a first push sleeve wall configured to at least partially surround said spring;

said top sub having a shoulder for pressing against said first push sleeve wall when said top sub is moved axially towards said mandrel body, whereby said top sub partially compresses said spring before said top sub abuts said first push sleeve wall.

5. The packer tool of claim 4, further comprising:

a first portion of said inner mandrel having means defining a J slot;

said lower slip body having a pin configured to travel within said J slot such that said lower slip body is limited in movement by said pin traveling within the J slot defined in the inner mandrel.

6. The packer tool of claim 1, further comprising:

a first portion of said inner mandrel having means defining a J slot;

said lower slip body having a pin configured to travel within said J slot such that said lower slip body is limited in movement by said pin traveling within the J slot defined in the inner mandrel.

7. A packer tool for releasably securing a packer within a well bore, the packer tool including:

an inner mandrel;

said inner mandrel having a longitudinal bore therein and an upper and a lower end;

a mandrel body selectively installed on said inner mandrel between an upper slip body and a lower slip body;

at least one packer on said mandrel body for expansion about said mandrel body to selectively seal a zone above said packer tool from a zone below said packer tool;

said mandrel body lower end further including an end portion movable relative to said mandrel body to cause said at least one packer to expand and engage the packer against the well bore;

said lower slip body selectively slidably mounted on a first portion of said inner mandrel to selectively compress said end portion to cause said at least one packer to expand and engage the packer against the well bore;

said upper slip body slidably mounted on said inner mandrel to compress said mandrel body between said upper slip body and said lower slip body;

said upper slip body mounted on said inner mandrel between said mandrel body and an top sub and having a spring housing enclosing a spring for urging said top sub away from said mandrel body;

said spring housing further having a first push sleeve wall configured to at least partially surround said spring;

said top sub having a shoulder for contacting and pressing against said first push sleeve wall to slide said upper slip body into said mandrel body when said top sub is moved axially towards said mandrel body, whereby said top sub partially compresses said spring before said top sub abuts said first push sleeve wall.

8. The packer tool of claim 7, wherein said first push sleeve wall has an axial length at least as long as said spring when said spring is in a fully compressed state.

9. The packer tool of claim 7, wherein said first push sleeve wall is concentric with said spring housing and said inner mandrel.

10. The packer tool of claim 7, wherein said first push sleeve wall is cylindrical and at least a portion of said first push sleeve wall is contained within said spring housing.

11. A packer tool for releasably securing a packer within a well bore, the packer tool including:

an inner mandrel;

said inner mandrel having a longitudinal bore therein and an upper and a lower end;

a mandrel body selectively installed on said inner mandrel between an upper slip body and a lower slip body;

at least one packer on said mandrel body for expansion about said mandrel body to selectively seal a zone above said packer tool from a zone below said packer tool;

said mandrel body having an upper end;

said inner mandrel lower end further including an end portion movable relative to said mandrel body to cause said at least one packer to expand and engage the packer against the well bore;

said lower slip body selectively slidably mounted on a first portion of said inner mandrel to selectively cause said end portion to move to cause said at least one packer to expand and engage the packer against the well bore;

said upper slip body slidably mounted on said inner mandrel to compress said mandrel body between said upper slip body and said lower slip body;

a first portion of said inner mandrel having means defining a J slot;

said lower slip body having a pin configured to travel within said J slot such that said lower slip body is limited in movement by said pin traveling within the J slot defined in the inner mandrel.

12. The packer tool of claim 11, wherein said inner mandrel includes a pathway between said inner mandrel and said mandrel body for selectively communicating the zone above said packer tool with the zone below said packer tool.

13. The packer tool of claim 12, wherein said inner mandrel includes a shoulder in axial alignment with a seal on said mandrel body along said pathway, such that when said upper slip body is compressed against said mandrel body, said shoulder contacts said seal to block said pathway and when said upper slip body is not in contact with said mandrel body said shoulder does not contact said seal to thereby open said pathway to communicate the zone above the packer tool and the below the packer tool.

14. The packer tool of claim 11, further comprising:

said upper slip body having a spring housing enclosing a spring for urging a top sub away from said mandrel body;

said spring housing further having a first push sleeve wall configured to at least partially surround said spring;

said top sub having a shoulder for pressing against said first push sleeve wall when said top sub is moved axially towards said mandrel body, whereby said top sub partially compresses said spring before said top sub abuts said first push sleeve wall.

15. The packer tool of claim 14, wherein said inner mandrel includes a pathway between said inner mandrel and said mandrel body for selectively communicating the zone above said packer tool with the zone below said packer tool.

16. The packer tool of claim 15, wherein said inner mandrel includes a shoulder in axial alignment with a seal on said mandrel body along said pathway, such that when said upper slip body is compressed against said mandrel body, said shoulder contacts said seal to block said pathway and when said upper slip body is not in contact with said mandrel body said shoulder does not contact said seal to thereby open said pathway to communicate the zone above the packer tool and the below the packer tool.

17. The packer tool of claim 11, wherein said J slot has a first run in position and a second maximum compression position.

18. The packer tool of claim 17, wherein said J pin in said J slot must be rotated to move from said maximum compression position to said run in position.

19. The packer tool of claim 18, wherein said J pin is a shear pin.

* * * * *